US009583878B2

(12) United States Patent
Bozikis

(10) Patent No.: US 9,583,878 B2
(45) Date of Patent: Feb. 28, 2017

(54) ELECTRICAL PLUG AND SOCKET SECUREMENT SYSTEM

(71) Applicant: Vaios Nikolaos Bozikis, Moraga, CA (US)

(72) Inventor: Vaios Nikolaos Bozikis, Moraga, CA (US)

( * ) Notice: Subject to any disclaimer, the term of this patent is extended or adjusted under 35 U.S.C. 154(b) by 0 days.

(21) Appl. No.: 14/450,303

(22) Filed: Aug. 4, 2014

(65) Prior Publication Data

US 2016/0036164 A1 Feb. 4, 2016

(51) Int. Cl.
*H01R 13/62* (2006.01)
*H01R 13/639* (2006.01)

(52) U.S. Cl.
CPC ..... *H01R 13/6392* (2013.01)

(58) Field of Classification Search
CPC ..... H01R 13/6392
USPC ..... 439/369, 296, 345, 144
See application file for complete search history.

(56) References Cited

U.S. PATENT DOCUMENTS 7,186,130 B1 * 3/2007 Miller ..... H01R 13/639 439/369

* cited by examiner

*Primary Examiner* — Vanessa Girardi
(74) *Attorney, Agent, or Firm* — S. Elizabeth Miller, Esq.

(57) ABSTRACT

An electrical plug fastener comprising a system of binding or securing electrical plugs to avoid unintentional or accidental disconnection. The system comprises a retention mechanism or means that connects to a first cord and a second cord. The retention mechanism is hinged and comprises a clamp. The clamp further comprises a clip that can also engage the first or second cord.

1 Claim, 3 Drawing Sheets

ELECTRICAL PLUG AND SOCKET SECUREMENT SYSTEM

BACKGROUND AND FIELD OF INVENTION

The invention relates to a fastener, lock, or clamp, for preventing electrical plugs from becoming unintentionally disconnected. Electrical plugs often become unintentionally disconnected when powering mobile devices such as power tools.

SUMMARY OF THE INVENTION

The purpose of this invention is to prevent unintentional separation of electrical plugs connecting electrically powered devices or power cords. One advantage of this invention is that it quickly engages or disengages to and from conjoining plugs, yet while engaged the connection is secure enough to ensure the plugs will remain connected until connection is intentionally broken. Another advantage to this invention is that the entire device is contained on one plug or is completely mobile so no specially designed plug is necessary to create a locked connection. In other words, this mechanism can lock to any standard plug.

BRIEF DESCRIPTION OF DRAWINGS

FIG. 1, the invention in an unmodified form stripped of electrical plugs to show what the invention is comprised of.

DETAILED DESCRIPTION OF THE INVENTION

Figure 1:
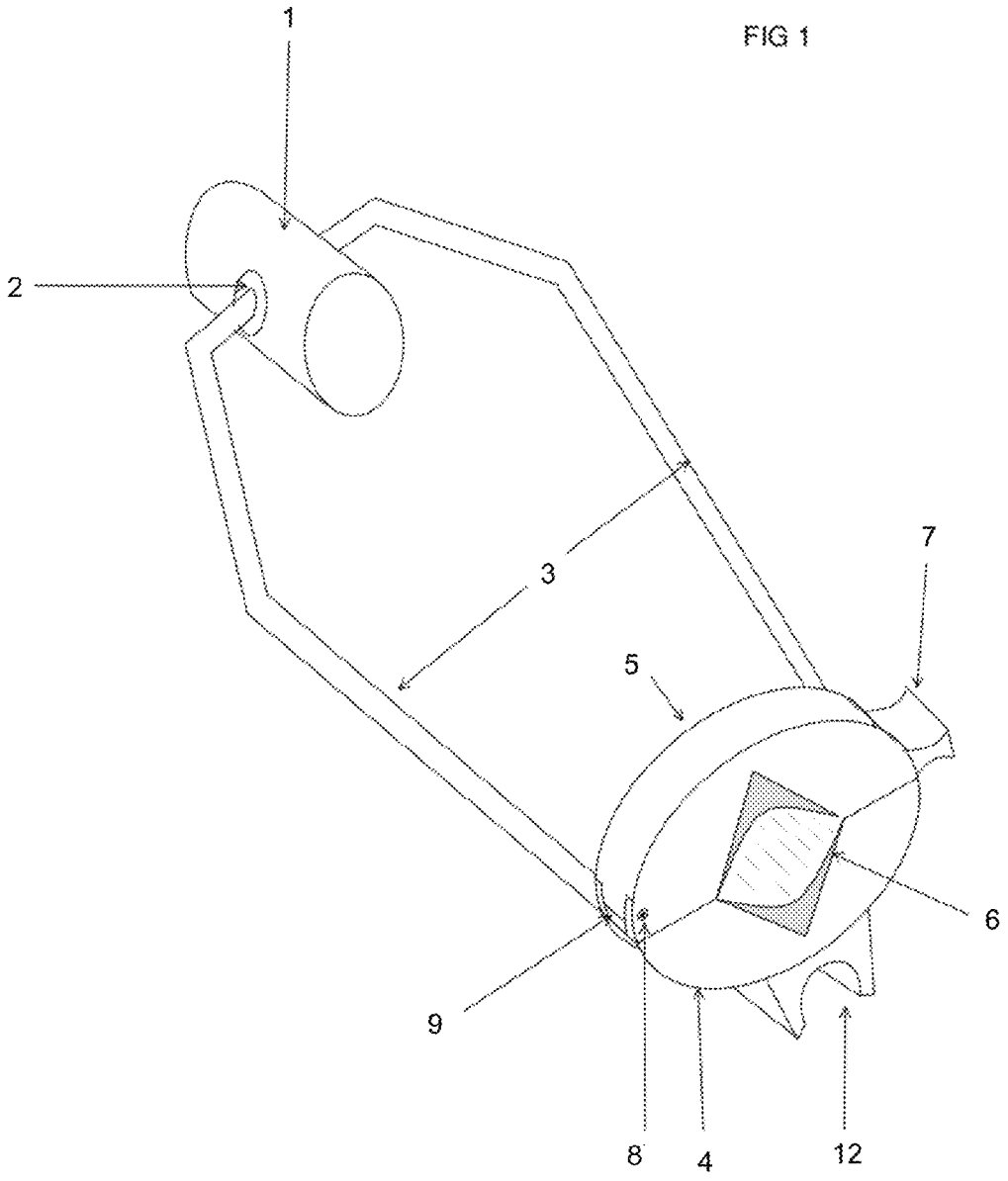
Figure 2:
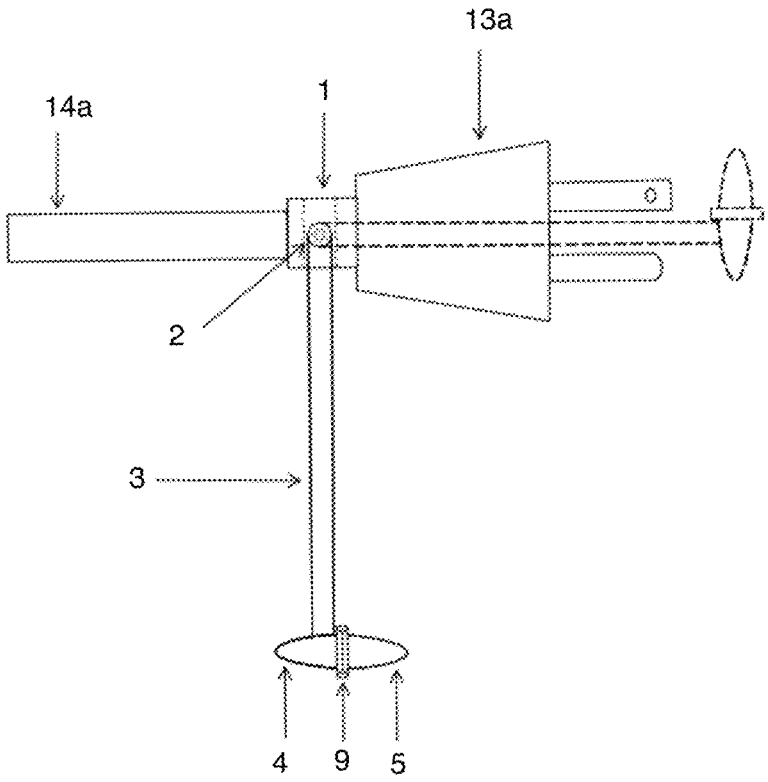
FIG. 2, side view of invention installed in electrical plug, showing how arms move clamp into engaged position.
Figure 3:
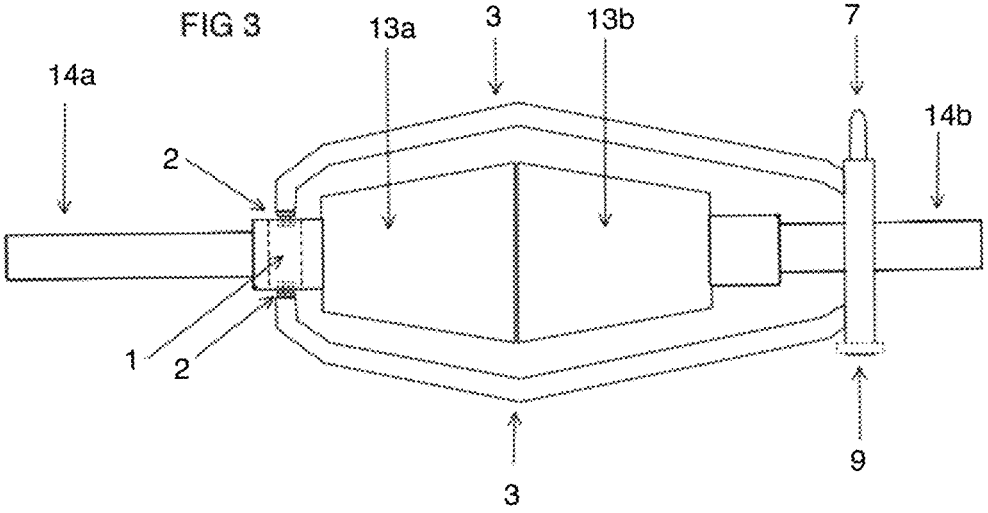
FIG. 3, top view of invention showing clamp installed in extrication plug, securing it to another plug.
Figure 4:
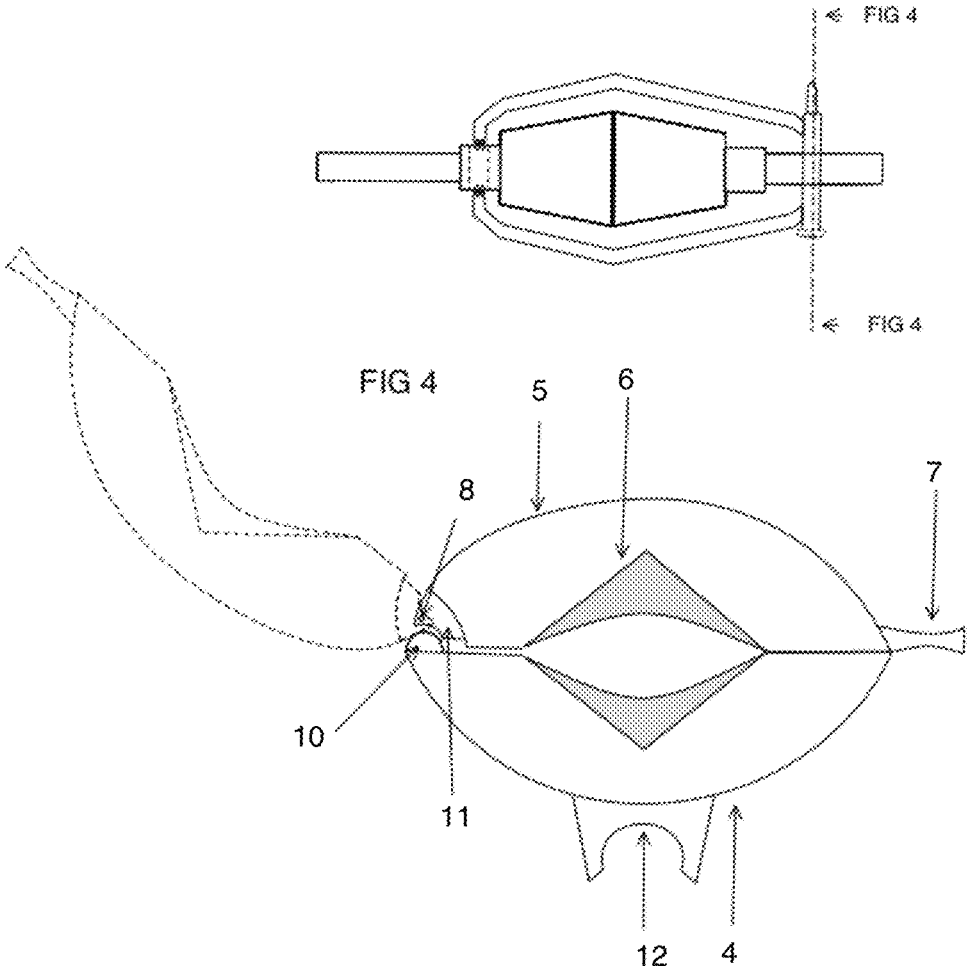
FIG. 4, cross-section of clamp.
Figure 5:
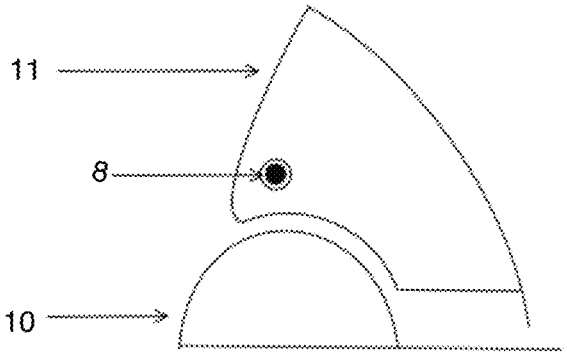
FIG. 5, close up of locking mechanism in clamp.

This mechanism fastens disconnect-able electrical plugs together so that accidental disconnection does not occur. It is designed to fasten the plugs together in a manner such that they will remain connected until intentionally disconnected, even under high amounts of force that may be susceptible to in construction zones when people are tugging on cords, or similar situations. The device is easily engaged or disengaged, yet when engaged, the connection is secure, so that the invention is efficient and effective.

The invention consists of a mechanism having a first side and a second side. The first side comprises a metal cylinder, or a retention mechanism, (1) imbedded in electrical plug where the electrical wiring runs through the cylinder, or retention mechanism. The cylinder, or retention mechanism, (1) comprises two holes that hold pins with stoppers on both sides of the holes, creating a first hinge, or hinged unit, (2).

The outer portion of the hinges are connected to metal arms, or bars, (3) (which may be coated in rubber). Arms, or bars, (3) extend out and around a first plug member (13*a*) and a second electrical plug member (13*b*), once clear of conjoining plug the arms (3) define and connect to the second side. The second side comprises a clamp having bottom portion of clamp (4) and top portion of the clamp (5). The arms (3) connect to bottom portion of clamp (4) which is connected to the top of the clamp (5) with a second hinge (9). The second hinge (9) consists of teeth and a pin (8), as well as a rounded bar (10) connected to bottom portion of clamp (4), and an elliptical piece (11) connected to the top of the clamp (5), which will create an increased point of friction right before clamp is fully engaged as to fix the clamp in the locked position. These two pieces (10) and (11) are made from polished stainless steel or a similar material as to not corrode, and to slide past each other at heightened point of friction. Both top and bottom portion of clamp (4) and (5) has a rubber center (6) allowing for a tight connection to the first cord (14*a*) without damaging it, and for increased friction between clamp and the second cord (14*b*). The top portion of clamp has a lever (7), allowing it to be manually engaged and disengaged. When disengaged, the clamp (4) may be secured to the same second cord (14*b*) as the base (1) (so as to not get in the way and flap around when clamp in knot needed) via a clip (12) attached to the bottom of clamp (4).

The clamp may be me modified to create a stronger connection, one example is the use of a clip (12) on side opposing hinge to ensure clamp stays closed.

The base (1) of mechanism may also be modified so that it is attachable semi permanently with screws. The metal cylinder can also be replaced with a clamp identical to the opposing end, as to make system quickly applicable to any set of plugs.

The invention claimed is:

1. A system of securing an electrical first plug member mated with a second electrical plug member such that unintentional disconnection does not occur;

the system comprising:

a first side which connects to a first plug member, or first cord;

wherein the first side comprises a retention mechanism which allows for engagement or disengagement from the mated second plug member;

wherein the retention mechanism comprises a hinged unit from which extends at least one bar, a distal end of the at least one bar defines a second side which comprises a clamp which engages the second plug member or second cord; and wherein the clamp comprises a top edge and a bottom edge, wherein the bottom edge is connected to a clip and said clip allows for engagement of the first cord or the second cord.

* * * * *